US006668594B2

(12) United States Patent
Okuno

(10) Patent No.: US 6,668,594 B2
(45) Date of Patent: Dec. 30, 2003

(54) TUBULAR FABRIC PLATING METHOD USING FOUR-BED FLAT KNITTING MACHINE

(75) Inventor: Masao Okuno, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/204,706

(22) PCT Filed: Feb. 26, 2001

(86) PCT No.: PCT/JP01/01439

§ 371 (c)(1),
(2), (4) Date: Aug. 23, 2002

(87) PCT Pub. No.: WO01/64988

PCT Pub. Date: Sep. 7, 2001

(65) Prior Publication Data

US 2003/0019247 A1 Jan. 30, 2003

(30) Foreign Application Priority Data

Feb. 29, 2000 (JP) ..... 2000-054065

(51) Int. Cl.[7] ..... D04B 7/04
(52) U.S. Cl. ..... 66/64; 66/136
(58) Field of Search ..... 66/64, 66, 69, 66/72, 147, 136, 137

(56) References Cited

U.S. PATENT DOCUMENTS 750,052 A * 1/1904 Greaud ..... 66/63
4,120,178 A * 10/1978 Kuhnert ..... 66/63
4,905,483 A * 3/1990 Shima ..... 66/64
6,021,651 A 2/2000 Shima

FOREIGN PATENT DOCUMENTS

JP 51-46871 12/1976
JP 52-17139 5/1977

* cited by examiner

*Primary Examiner*—Danny Worrell
(74) *Attorney, Agent, or Firm*—Rothwell, Figg, Ernst & Manbeck

(57) ABSTRACT

A plating method for knitting a tubular fabric by using a four-bed type flat knitting machine comprising a first lower needle bed and a second lower needle bed which are arranged in pair in front and back and a first upper needle bed and a second upper needle bed which are arranged over the respective lower needle beds, wherein a first knitting fabric including a rib knitting knitted with needles on the first lower needle bed and the second upper needle bed and a second knitting fabric including a rib knitting knitted with needles on the first upper needle bed and the second lower needle bed are joined together at each widthwise side end thereof, so as to be knitted into a tubular form and the knitting fabrics are each knitted to have a plated structure by using a front yarn and a back yarn, and wherein a yarn feeder for the front yarn is displaced in each knitting in such a manner that when the first knitting fabric is knitted, the front yarn can be made closer to the second upper needle bed than the back yarn and when the second knitting fabric is knitted, the front yarn can be made closer to the first upper needle bed than the back yarn, whereby the condition for the front yarn and the back yarn to be fed is steadied to produce a neat plating fabric without mottles.

3 Claims, 4 Drawing Sheets

TUBULAR FABRIC PLATING METHOD USING FOUR-BED FLAT KNITTING MACHINE

TECHNICAL FIELD

The present invention relates toga plating method using four-bed flat knitting machine and, more particularly, to a plating method for knitting knitwear, such as a sweater and a cardigan, seamlessly.

BACKGROUND ART

Plating is a knitting technique used to produce, for example, reversible fabrics, or used to improve stretch of fabrics by an elastic yarn used as a plating yarn, such as woolly nylon, being woven in a plating relationship with the main yarn. In the plating, the back yarn is wrapped by the front yarn in such a yarn feeding condition that the front yarn shows on the front side of the formed loop and the back yarn hides on the reverse side (back side) of the same. Consequently, in the plating, a specially-designed yarn feeder is used for allowing the front yarn to be in a lower position than the back yarn so that the back yarn can be positioned nearer to the needle hook than the front yarn at the yarn-feeding position and the front yarn and the back yarn can be spaced from each other in the vertical direction so that they can be captured by the knitting needles. Examples of the specially-designed yarn feeder are the yarn feeder having the structure wherein a front-yarn yarn feeding guide is made ahead of a back-yarn yarn feeding guide, the yarn feeder having the structure wherein the front-yarn yarn feeding guide is in a lower position than the back-yarn yarn feeder, and the yarn feeder having both of these structures.

These yarn feeders operate well in the so-called two-bed flat knitting machines of general type comprising a pair of front and back needle beds, to produce a neat plating fabric. However, there is presented the problem when such a yarn feeder is used with the so-called four-bed flat knitting machine comprising first and second lower needle beds arranged in pair in front and back and first and second upper needle beds disposed over the pair of lower needle beds, as disclosed by Japanese Patent Publication No. Hei 1(1989)-57173. The flat knitting machine having this structure was developed particularly for the purpose of knitting a seamless knitwear whose front fabric and back fabric knitted in layers in front and back are joined together at each widthwise side end thereof so as to be knitted into a tubular form. In the knitting of the seamless knitwear, the front loops of the front knitting fabric are knitted with the needles of the first lower needle bed, and the back loops are knitted with the needles of the second upper needle bed. Also, the front loops of the back knitting fabric are knitted with the needles of the second lower needle bed, and the back loops are knitted with the needles of the first upper needle bed. In the tubular plating fabric including a rib knitting structure knitted in this manner, the front yarn and the back yarn are caused to change over positions in spots to thereby produce a mottled fabric and, as a result of this, a neat plating fabric cannot be produced.

This stems from the structure of the needle beds of the four-bed flat knitting machine wherein the upper needle beds are disposed in a nearly horizontal position, as compared with the lower needle beds. After having devoted himself to study this, the inventor found the fact that since the needles on the upper needle beds follow a further nearly horizontal track, the yarns are drawn in by the needle hooks with an insufficient time difference between the timing for the front yarn to be drawn in by the needle hook and the timing for the back yarn to be drawn in by the needle hook and, as a result of this, the positional relationship between the front yarn and the back yarn is made unstable to sometimes cause the front yarn and the back yarn to change over positions.

In the light of the problem involved in the plating knitting by the four-bed flat knitting machine, the present invention had been made. It is the object of the present invention to provide a knitting method to steady the condition for the front yarn and the back yarn to be fed, so as to produce a neat plating fabric without mottles.

DISCLOSURE OF THE INVENTION

The present invention provides a plating method for knitting a tubular fabric by using a four-bed type flat knitting machine comprising a first lower needle bed and a second lower needle bed which are arranged in pair in front and back and a first upper needle bed and a second upper needle bed which are arranged over the respective lower needle beds, wherein a first knitting fabric including a rib knitting knitted with needles on the first lower needle bed and the second upper needle bed and a second knitting fabric including a rib knitting knitted with needles on the first upper needle bed and the second lower needle bed are joined together at each widthwise side end thereof, so as to be knitted into a tubular form and the knitting fabrics are each knitted to have a plated structure by using a front yarn and a back yarn, and wherein a yarn feeder for the front yarn is displaced in each knitting in such a manner that whenever the first knitting fabric is knitted, the front yarn can be made closer to the second upper needle bed than the back yarn and whenever the second knitting fabric is knitted, the front yarn can be made closer to the first upper needle bed than the back yarn.

Preferably, the front yarn is made closer to the second upper needle bed, rather than to a center of a needle bed gap between the needle beds, to knit the first knitting fabric and the front yarn is made closer to the first upper needle bed, rather than to the center of the needle bed gap between the needle beds, to knit the second knitting fabric.

Preferably, the back yarn is made closer to the first lower needle bed, rather than to a center of a needle bed gap between the needle beds, to knit the first knitting fabric and the back yarn is made closer to the second lower needle bed, rather than the center of the needle bed gap between the needle beds, to knit the second knitting fabric.

BRIEF DESCRIPTION OF THE DRAWINGS

FIG. 2-*b* shows the positional relationship between the front yarn and the back yarn in the course of leftward knitting parts;

BEST MODE FOR CARRYING OUT THE INVENTION

Figure 1:
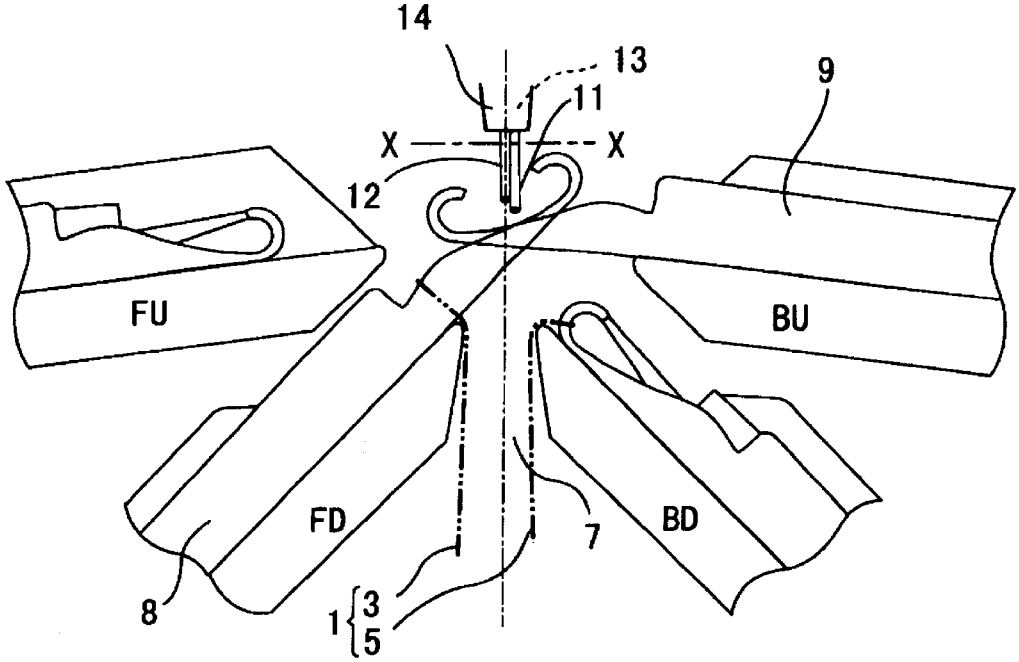
FIG. 1 shows a side view of a four-bed flat knitting machine around a needle bed gap.

In the following, certain preferred embodiments of the present invention will be described in detail with reference to the accompanying drawings. FIG. 1 shows a side view of a four-bed flat knitting machine around a needle bed gap, which comprises a lower front needle bed FD and a lower back needle bed BD which are arranged in pair in front and back and an upper front needle bed FU and an upper back needle bed BU which are arranged in pair in front and back. Illustrated herein is the state that a tubular fabric comprising a front knitting fabric and a back knitting fabric, or rather a front body 3 of a pullover sweater body 1, is knitted by rib knitting with needles 8 of the lower front needle bed FD and needles 9 of the upper back needle bed BU.

Figure 2:
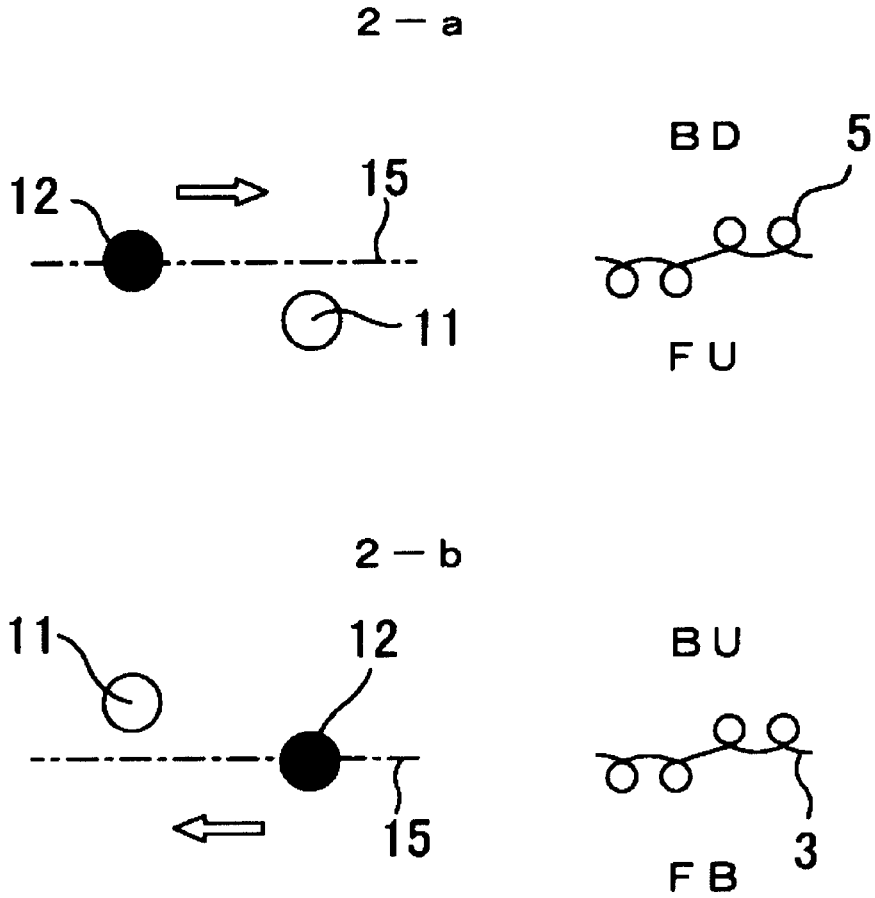
FIG. 2-*a* shows the positional relationship between the front yarn and the back yarn in the course of rightward knitting.

FIG. 2 shows the alignment of a front yarn 11 and a back yarn 12 with respect to line X—X of FIG. 1 when the body 1 of the sweater is cyclically knitted in the clockwise direction. A chain line 15 in the diagram shows a center line in a needle bed gap between the front and back needle beds. A yarn feeder 13 used for the front yarn 11 is optionally rotatable 180 degree in accordance with the knitting condition and has a yarn feed guide disposed at an offset position from the rotation axis, though not shown. On the other hand, a yarn feeder 14 used for the back yarn 12 has a yarn feed guide for the back yarn 12 that takes a position behind the yarn feed guide for the front yarn 11 when knitting.

FIG. 2-*a* shows the positional relationship between the front yarn 11 and the back yarn 12 when the back body 5 is knitted rightwards in rib knitting with the needles on the lower back needle bed BD and the needles on the upper front needle bed FU. The front yarn 11 is so set that it can approach the upper front needle bed FU beyond the center of the needle bed gap 7 and also is so set as to be in a position ahead of the back yarn 12. In this structure, since the front yarn 11 and the back yarn 12 for plating are spaced from each other in a front-and-back direction with respect to the needles on the upper needle beds, the yarn feeding condition is modified, and as such can ensure that the back yarn 12 is wrapped by the front yarn 11. On the other hand, the front yarn 11 and the back yarn 12 are put in reverse position with respect to the needles of the lower needle beds, so that it may appear that the yarn feeding condition is made worse, but since the lower needle beds are set in a nearly vertical position, as compared with the upper needle beds, such deterioration is cancelled. When knitting in this yarn feeding manner, the front yarn and the back yarn are prevented from changing over positions at any stitches knitted with the needles of either of the upper needle beds and the lower needle beds and thus no mottles are produced thereat, differently from the prior art.

FIG. 2-*b* shows the positional relationship between the front yarn 11 and the back yarn 12 when the front body 3 is knitted leftwards in rib knitting with the needles on the lower front needle bed FD and the needles on the upper back needle bed BU. The front yarn 11 is so set as to be in a position ahead of the back yarn 12 and also is displaced so that it can approach the upper back needle bed BU beyond the center of the needle bed gap, thus ensuring that the back yarn 12 is wrapped by the front yarn 11 in each of the front and back needle beds in the same manner as in the above structure.

With this method, whenever the knitting is reversed in direction, the front yarn 11 is knitted while being displaced so as to get closer to the upper needle bed to be used for the knitting, thus producing a neat tubular plating fabric without mottles.

While in the embodiment illustrated above, the body 1 is cyclically knitted in the clockwise direction, the body 1 may be cyclically knitted in the counterclockwise direction. In that case, the yarn alignment is opposite to the yarn alignment mentioned above, and the back body 5 is knitted in the condition in which the front yarn 11 is so set that it can get closer to the upper front needle bed FU than the back yarn 12 when knitting leftwards, and the front body 3 is knitted in the condition in which the front yarn 11 is so set that it can get closer to the upper back needle bed BU than the back yarn 12 when knitting rightwards. Likewise, when the front body is knitted with the needles on the lower back needle bed BD and the needles on the upper front needle bed FU and when the back body is knitted with the needles on the lower front needle bed FD and the needles on the upper back needle bed BU, the yarn alignment is made to be opposite to the yarn alignment mentioned above.

Next, reference will be made to the cyclic knitting of a tubular fabric having a front open part in the front body, such as a cardigan.

Figure 3:
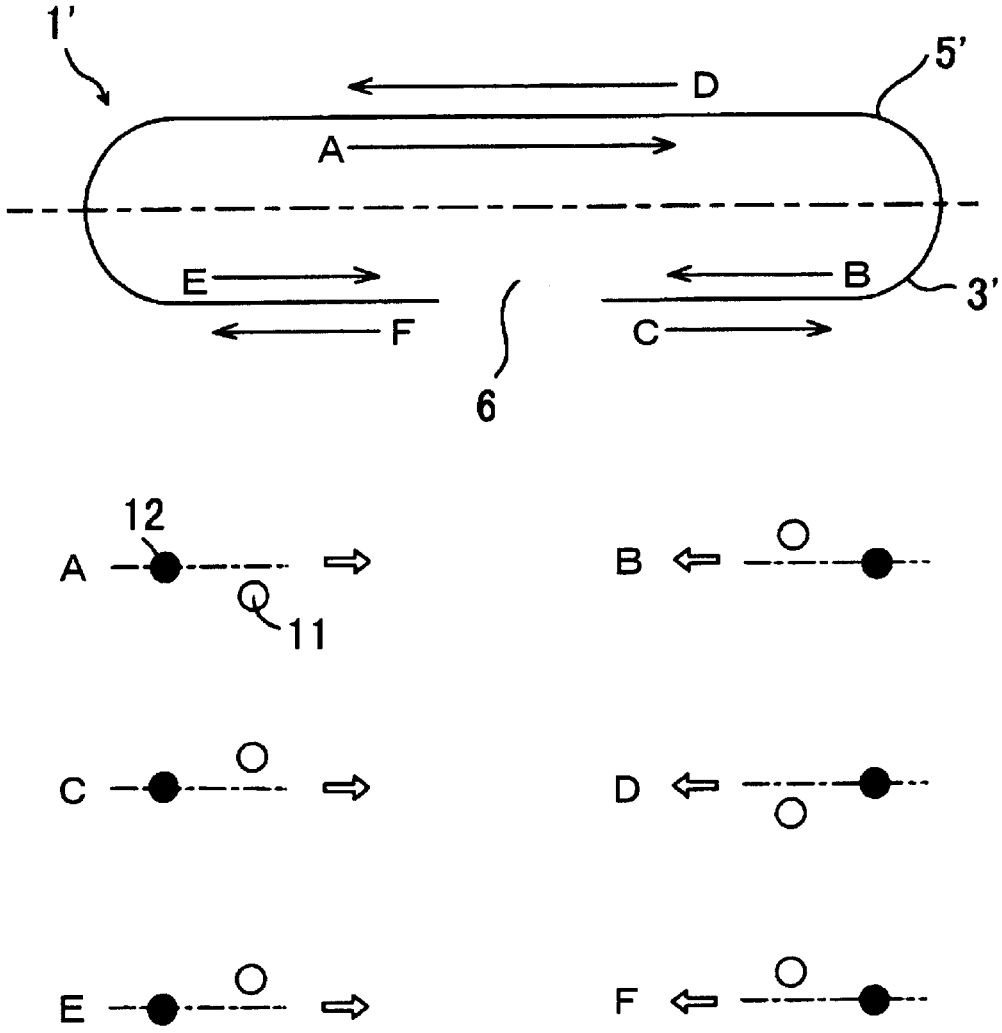
FIG. 3 shows the positional relationship between the front yarn and the back yarn in the cyclic knitting of a tubular fabric having a front open part in the front body, such as a cardigan.

FIG. 3 shows the alignment of the front yarn 11 and the back yarn 12 in the cyclic knitting of the body 1' of the cardigan having the front open part 6 in the front body 3'. The front body 3' is knitted with the needles on the lower front needle bed FD and the needles on the upper back needle bed BU, and the back body 5' is knitted with the needles on the lower back needle bed BD and the needles on the upper front needle bed FU. The same yarn feeder as that used in the embodiment illustrated above is used.

As illustrated, the body 1' is knitted in the order of A back body—B left front body—C left front body—D back body—E right front body—F right front body as if the alphabetic character "C" is drawn, while the yarn feeder is reversed in direction at the front open part 6. In this embodiment also, the knitting is performed in the following condition, as is the case with the previous embodiment: In the course knitting at B, C, E and F of the front body 3' in which the needles on the upper back needle bed BU are actuated, the front yarn 11 is so set as to be closer to the upper front needle bed FU than the back yarn 12, and in the course knitting at A and D of the back body 5' in which the needles on the upper front needle bed FU are actuated, the front yarn 11 is so set as to be closer to the upper back needle bed BU than the back yarn 12.

Figure 4:
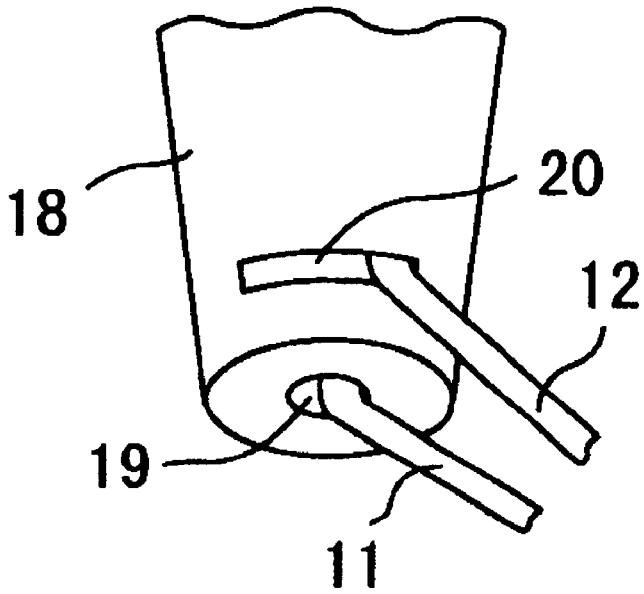
FIG. 4 shows an example of yarn feeder used for the knitting method of the present invention.
Figure 4:
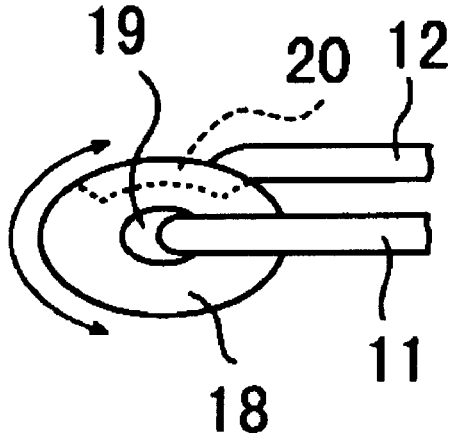

While in the embodiments illustrated above, the front yarn is displaced so as to approach the upper needle bed to be used for the knitting from the center of the needle bed gap, the back yarn may alternatively be displaced so as to approach the lower needle bed to be used for the knitting. However, when the back yarn is displaced too much, it cannot be captured by the needle hook. Accordingly, the displacement of the back yarn need be regulated to an extent that can capture the yarn. This can be provided by producing a single yarn feeder shown in FIG. 4, for example. Specifically, this yarn feeder includes a yarn feeding guide 19 for the front yarn formed at the center of the yarn feeding part 18; and a yarn feeding guide 20 for the back yarn formed by an opening which is formed at the side of the yarn feeding part 18 so as to be higher than the yarn feeding guide 19 for the front yarn. Also, the yarn feeding part 18 is so structured as to rotate 180 degree about the rotation axis of the yarn feeding guide 19 so that it can rotate in accordance with the knitting condition to change over position of the back yarn 12. This yarn feeder can provide the advantage of putting the method of the invention into practice with a relatively simple structure. In short, it is essential for the invention that the front yarn and the back yarn are spaced from each other in the front-and-back direction in such a relation that the front yarn can get closer to the needles on the upper needle bed to be used for knitting than the back yarn.

Capabilities of Exploitation in Industry

As mentioned above, according to the present invention, whenever a tubular plating fabric including a rib knitting is knitted by using the four-bed type flat knitting machine, the yarn is fed in such a manner that the front yarn can be displaced so as to be closer to the needles on the upper needle bed to be used for knitting the front knitting fabric or the back knitting fabric than the back yarn. This can ensure that the back yarn is well wrapped by the front yarn even when the upper needle bed is not necessarily suitable for knitting the tubular plating fabric, and as such can produce a neat plating fabric.

What is claimed is:

1. A plating method for knitting a tubular fabric by using a four-bed type flat knitting machine comprising a first lower needle bed and a second lower needle bed which are arranged in a front to back relationship, and a first upper needle bed and a second upper needle bed which are arranged over the respective lower needle beds, wherein a first knitting fabric including a rib knitting knitted with needles on the first lower needle bed and the second upper needle bed and a second knitting fabric including a rib knitting knitted with needles on the first upper needle bed and the second lower needle bed are joined together at each widthwise side end thereof, into a tubular form and the first and second knitting fabrics are each knitted to have a plated structure by using a front yarn and a back yarn, said method the comprising steps of: displacing a yarn feeder for the front yarn when the first knitting is knitted to make the front yarn closer to the second upper needle bed than the back yarn, and displacing the yarn feeder when the second upper needle bed is knit to make the front yarn closer to the first upper needle bed than the back yarn.

2. The plating method for knitting the tubular fabric by using the four-bed type flat knitting machine according to claim 1, wherein the front yarn is made closer to the second upper needle bed, rather than to a center of a needle bed gap between the needle beds, to knit the first knitting fabric and the front yarn is made closer to the first upper needle bed, rather than to the center of the needle bed gap between the needle beds, to knit the second knitting fabric.

3. The plating method for knitting the tubular fabric by using the four-bed type flat knitting machine according to claim 1, wherein the back yarn is made closer to the first lower needle bed, rather than to a center of a needle bed gap between the needle beds, to knit the first knitting fabric and the back yarn is made closer to the second lower needle bed, rather than to the center of the needle bed gap between the needle beds, to knit the second knitting fabric.

* * * * *